United States Patent [19]

Yoshihito et al.

[11] Patent Number: 4,647,177

[45] Date of Patent: Mar. 3, 1987

[54] ELECTROPHOTOGRAPHIC COPIER

[75] Inventors: Urata Yoshihito, Katano; Sasaki Toshiharu, Kawanishi; Yokoyama Yoshihiro, Settu; Sekine Yoichi, Yokohama, all of Japan

[73] Assignee: Matsushita Electric Industry Co, Ltd., Osaka, Japan

[21] Appl. No.: 647,735

[22] Filed: Sep. 6, 1984

[30] Foreign Application Priority Data

Sep. 9, 1983 [JP] Japan ..... 58-166980
Oct. 21, 1983 [JP] Japan ..... 58-197821
Oct. 24, 1983 [JP] Japan ..... 58-198523

[51] Int. Cl.[4] ..... G03G 15/00

[52] U.S. Cl. ..... 355/3 BE; 355/3 CH; 355/14 CH; 355/15

[58] Field of Search ..... 355/3 BE, 3 R, 15, 14 E, 355/16

[56] References Cited

U.S. PATENT DOCUMENTS 3,697,160 10/1972 Clark ..... 355/16 X
3,788,739 1/1974 Coriale ..... 355/3 R X
3,972,609 8/1976 Pfeifer et al. ..... 355/16 X
4,062,631 12/1977 Ichikawa et al. ..... 355/16 X
4,378,154 3/1983 Hoffman ..... 355/3 BE X

OTHER PUBLICATIONS

Noto, "Copier With Single Corona Discharge Device", *Xerox Disclosure Jrnl.*, vol. 1, No. 2, Feb. 1976.

*Primary Examiner*—A. C. Prescott
*Attorney, Agent, or Firm*—Wenderoth, Lind & Ponack

[57] ABSTRACT

An electrophotographic copier comprises a photosensitive belt supported on first and second rollers and driven thereby, a development unit, a single transfer corotron, and an exposure unit. The development unit is disposed adjacent to the first roller, and the single transfer corotron is positioned on one side of a line connecting the first and second rollers, while the exposure unit is positioned on the other side of the line. The corotron charges the photosensitive belt during a first rotation of the belt around the rollers and causes transfer of a developed image from the photosensitive surface of the belt during a second rotation of the belt around the rollers.

9 Claims, 6 Drawing Figures

ELECTROPHOTOGRAPHIC COPIER

BACKGROUND OF THE INVENTION

1. Field of the Invention

The present invention relates to an electrophotographic copier, and more particularly to an electrophotographic copier employing a photosensitive (photoconductive) belt.

2. Description of the Prior Art

Electrophotographic copiers according to the Carlson process operate in complex processes. The construction and operation of such a copier will be briefly described below.

The surface of a photosensitive body is uniformly charged by a charging corotron, and a light image reflected from an original document which is illuminated with light is focused through a lens system onto the photosensitive body, thereby forming an electrostatic latent image. Toner is applied by a development unit to the electrostatic latent image, which is turned into a visible toner image. The toner image is then transferred electrostatically to a transfer sheet by a transfer corotron. The transfer sheet carrying the toner image is discharged by a peeling AC corotron, and is peeled off the photosensitive body and delivered to a fixing unit. Residual toner which has not been transferred to the transfer sheet is scraped off the photosensitive body by a cleaning blade. Thereafter, the photosensitive body is discharged by a discharge AC corotron. Then, the electrophotographic copier enters a charging process again.

With the above arrangement, the electrophotographic copier requires several corotrons for charging, transferring, peeling, and discharging, and also a toner collector box for storing toner scraped off by the cleaning blade. Therefore, the copier is complex in construction. Where the photosensitive body comprises a drum, the drum has a large diameter and the body of the copier is necessarily large in size.

In general, toner tends to be scattered from the development unit into the copier body. The conventional copier is disadvantageous in that the toner from the development unit smears the transfer sheet, the corotrons, and even the lens.

Since the amount of toner which is not transferred to the transfer sheet is large, various proposals have been made to reuse such toner for thereby lowering the operating cost. However, any device for delivering toner from the toner collector box is liable to be complicated in structure.

The photosensitive bodies used include a belt and a drum. The photosensitive belt is more difficult to detect in its angularly displaced position than the photosensitive drum. One solution proposed heretofore is to provide prongs on the outer periphery of a roller which drives the photosensitive belt, the prongs being fitted in holes in the photosensitive belt to drive the belt at the same speed as that of the roller. The angular displacement of the photosensitive belt can be determined by detecting the rotational position of the roller. Since the photosensitive belt is forcibly driven by the prongs, the holes in the photosensitive belt in which the prongs fit have to be sufficiently reinforced. Another solution is to put a marking on a transverse edge of the photosensitive belt and to read the marking with a sensor. This arrangement has a drawback in that deposits of toner on the photosensitive belt are likely to cause the sensor to produce a readout error.

SUMMARY OF THE INVENTION

It is an object of the present invention to provide an electrophotographic copier which operates in a simplified electrophotographic process and have a low profile and high reliability.

Another object of the present invention is to provide an electrophotographic copier having a toner collector device of a simple construction capable of efficiently collecting non-transferred residual toner from a photosensitive body into a development unit.

Still another object of the present invention is to provide an electrophotographic copier capable of reliably detecting the operating position of a photosensitive belt.

An electrophotographic copier according to the present invention comprises at least first and second roller means, a photosensitive belt trained around the first and second roller means and drivable to travel in one direction, a development means disposed adjacent to the first roller means, exposure means disposed on one side of a line connecting the first and second roller means, and transfer means disposed on the other side of the line for transferring an image developed by the development means from the photosensitive belt to a transfer member.

With the arrangement of the invention, charge and transfer can be effected by one corotron, and the transfer member can be efficiently peeled off the photosensitive member. The electrophotographic copier is thus simplified in construction and of a low profile. The development means, the transfer means, and the exposure means are positioned in spaced relation so that the transfer means and the exposure means will be prevented from getting smeared with toner scattered from the development means. Non-transferred residual toner is scraped off the photosensitive belt, deposited thereon again, and delivered to the development means. Accordingly, toner can be reused reliably with the simple construction. Another advantage is that a means for detecting the angular position of the photosensitive belt is disposed on and inwardly of the belt, and hence error in detecting the operating position is prevented which would otherwise occur if the belt was smeared with a deposit of toner.

The above and other objects and features of the present invention will become apparent from the following description taken in connection with the accompanying drawings in which:

DESCRIPTION OF THE PREFERRED EMBODIMENT

An embodiment of the present invention will be described hereinbelow with reference to the drawings.

Figure 2:
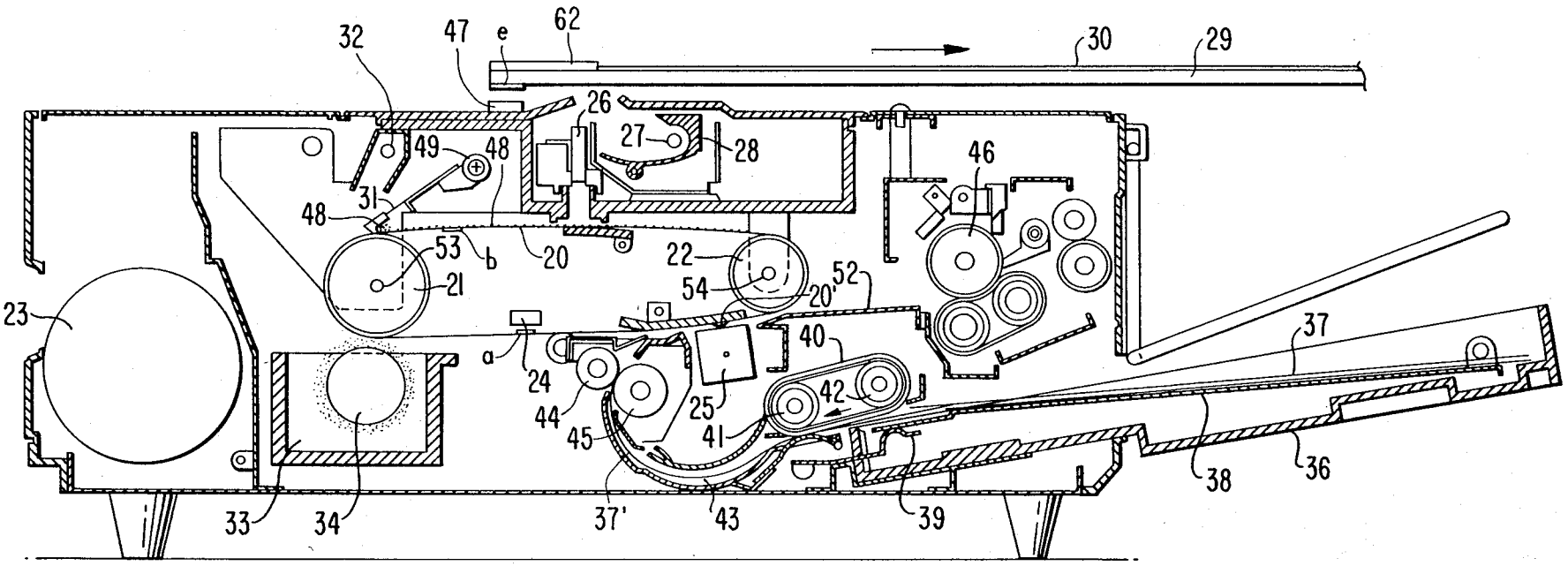
FIGS. 2 through 5 are sectional side elevational views of the electrophotographic copier, showing successive operation steps.
Figure 6:
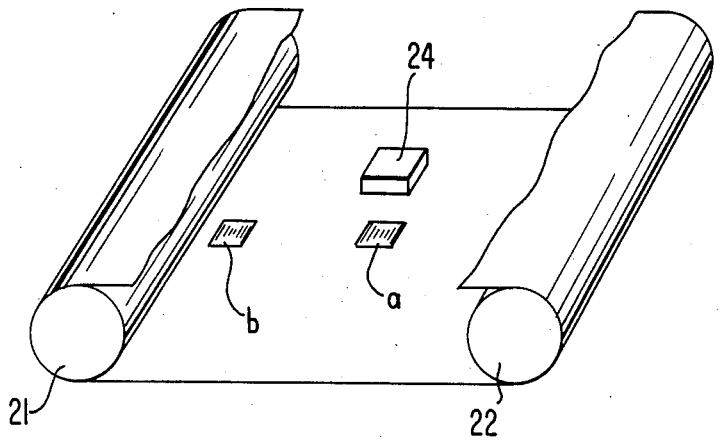
FIG. 6 is a fragmentary enlarged perspective view of a portion of the electrophotographic copier.

As shown in FIG. 2, a photosensitive (photoconductive) belt 20 is composed of a polyester film coated with a photosensitive (photoconductive) material and formed as an endless belt, the photosensitive belt 20 having a joined seam 20'. The photosensitive belt 20 is trained around first and second rollers 21, 22 mounted on shafts, 53,54, respectively, and driven to travel counterclockwise by the power from a motor 23. The motor 23 is operatively coupled to the first roller 21 by a drive mechanism (not shown). As illustrated in FIG. 6, a photosensitive belt position sensor 24 detects the angular position of the photosensitive belt 20 by detecting markings a, b, c put substantially centrally on the reverse side of the photosensitive belt 20. In one embodiment, the sensor 24 comprises a reflective optical sensor composed of a light-emitting element and a photodetector which are constructed as a unit. The markings a, b, c are formed by painting the reverse side of the photosensitive belt 20 with black coatings. The sensor 24 detects the angular position of the photosensitive belt 20 by sensing the difference between the optical reflectivities of the photosensitive belt 20 and the markings a, b, c. Other arrangements may be possible for detecting the angular position of the photosensitive belt 20, such as by applying the markings a, b, c to the reverse side of the photosensitive belt 20.

A corotron 25 serves to produce a corona discharge, and charges the photosensitive belt 20 or transfers an image therefrom by changing voltages applied to the corotron 25.

A light beam emitted from an exposure lamp 27 is focused by a reflecting plate 28 on an original document 30 placed on a document support 29. A reflecting light beam or a light image from the original document 30 is focused by a fiber lens array 26 onto the photosensitive belt 20.

A cleaning blade 31 has a resilient member 31' on its distal end and is selectively moved upwardly and downwardly by a drive mechanism, not shown. When lowered, the resilient member 31' is pressed against the photosensitive belt 20 to scrape non-transferred toner off the photosensitive belt 20. A discharging lamp 32 is effective in removing residual electric charges from the surface of the photosensitive belt 20 after the non-transferred toner has been scraped off.

Transfer sheets 37 of paper are placed on a paper feed plate 38 in a paper feed cassette 36, and pressed against a paper feed belt 40 by a presser plate 39. The paper feed belt 40 is trained around rollers 41, 42. Timing rollers 44, 45 are electrically controlled to deliver the transfer sheet 37' in synchronism with the photosensitive belt 20.

A fixing unit 46 serves to fix the transferred toner on the transfer sheet 37.

A document support position sensor 47 detects markings d, e, f attached to the original support 29.

Figure 1:
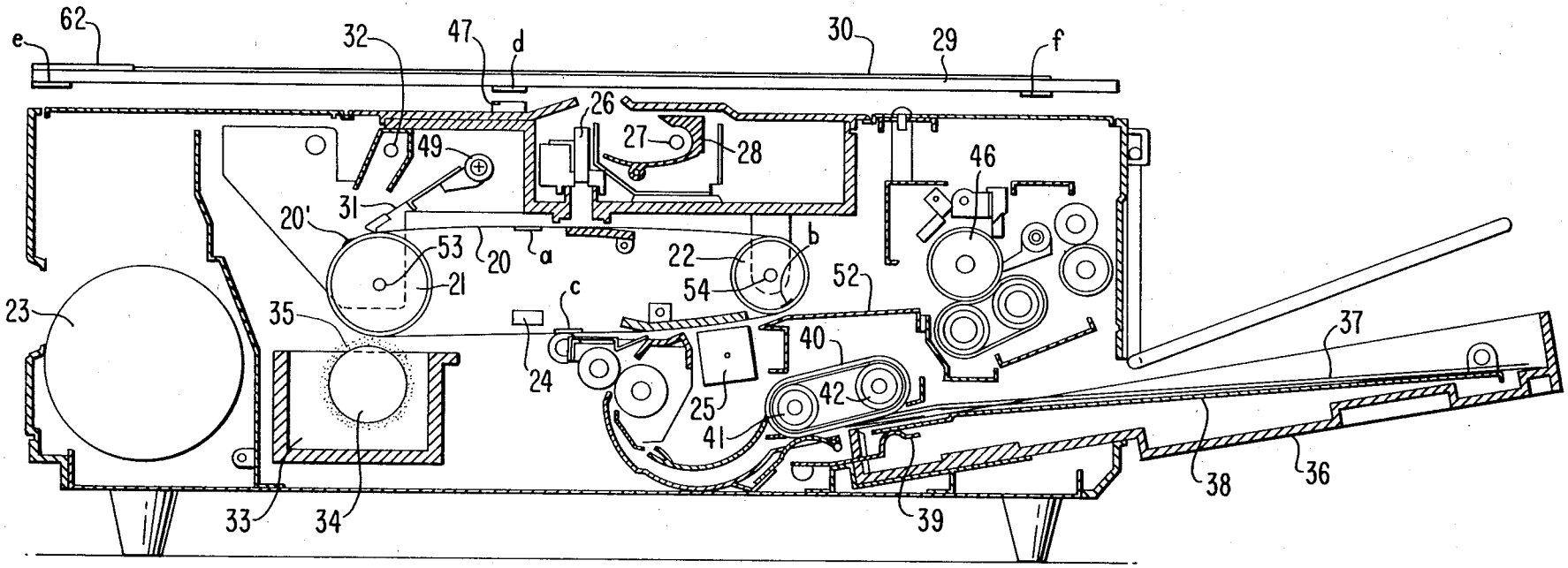
FIG. 1 is a sectional side elevational view of an electrophotographic copier according to an embodiment of the present invention.

Operation of the electrophotographic copier thus constructed will be described below:

(1) Start of copying operation:

The motor 23 is energized to move the photosensitive belt 20 in the direction of the arrow from the position of FIG. 1 to the position of FIG. 2, and at the same time the document support 29 is retracted to the right in the direction of the arrow. The document support 29 is stopped when the document support position sensor 47 detects the marking e.

The paper feed belt 40 is rotated in the direction of the arrow to feed a transfer sheet 37' into a paper feed passage 43. When the leading end of the transfer sheet 37' reaches the timing rollers 44, 45, the paper feed belt 40 is stopped to complete the paper feeding operation.

(2) Start of charging:

As the photosensitive belt 20 is rotated and the photosensitive belt position sensor 24 detects the marking a on the reverse side of the photosensitive belt 20, as shown in FIG. 2, the corotron 25 is energized to start charging the photosensitive belt 20 uniformly. By this time, as illustrated in FIG. 2, the surface of the photosensitive belt 20 has been cleaned by scraping residual toner 48 with the cleaning blade 31, and residual electric charges have been removed from the photosensitive belt 20 by discharging light emitted from the discharging lamp 32. Therefore, the photosensitive belt 20 as it moves past the development unit 33 has a cleaned surface.

(3) Start of exposure:

The photosensitive belt 20 is further rotated from the charging start position of FIG. 2. As the joined seam 20' moves substantially past a position below the fiber lens array 26, that is, as the photosensitive belt position sensor 24 detects the marking b, the exposure lamp 27 is turned on and the document support 29 starts moving to the left at the same speed as that of the photosensitive belt 20. The image of the original document 30 is now projected onto the surface of the photosensitive belt 20, thereby forming an electrostatic latent image thereon.

Figure 3:
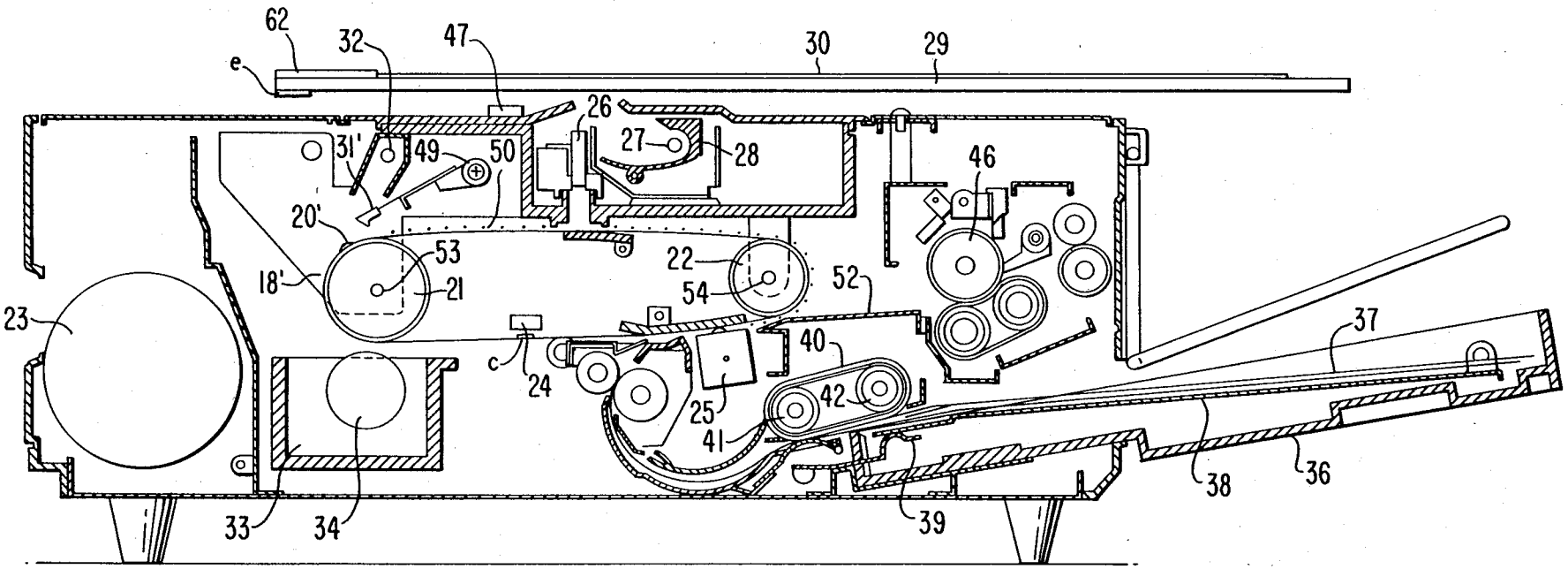

When the joined seam 20' substantially reaches the cleaning blade 31 as shown in FIG. 3, that is, when the photosensitive belt position sensor 24 detects the marking c, the cleaning blade 31 is turned about a shaft 49 away from the surface of the photosensitive belt 20. At this time, a mass of non-transferred toner 48' which has been scraped by the cleaning blade 31 and collected on the photosensitive belt 20 is moved on and with the belt 20, and then falls into the development unit 33, in which the toner is mixed with other toner in the development unit 33 for reuse.

At the same time that the cleaning blade 31 is retracted, the discharging lamp 32 is de-energized. Therefore, the cleaning blade and the discharging light will not impair an electrostatic latent image 50 formed on the photosensitive belt 20.

Through the foregoing steps of operation, the photosensitive belt 20 has completed one rotation from the initial position of FIG. 1.

Figure 4:
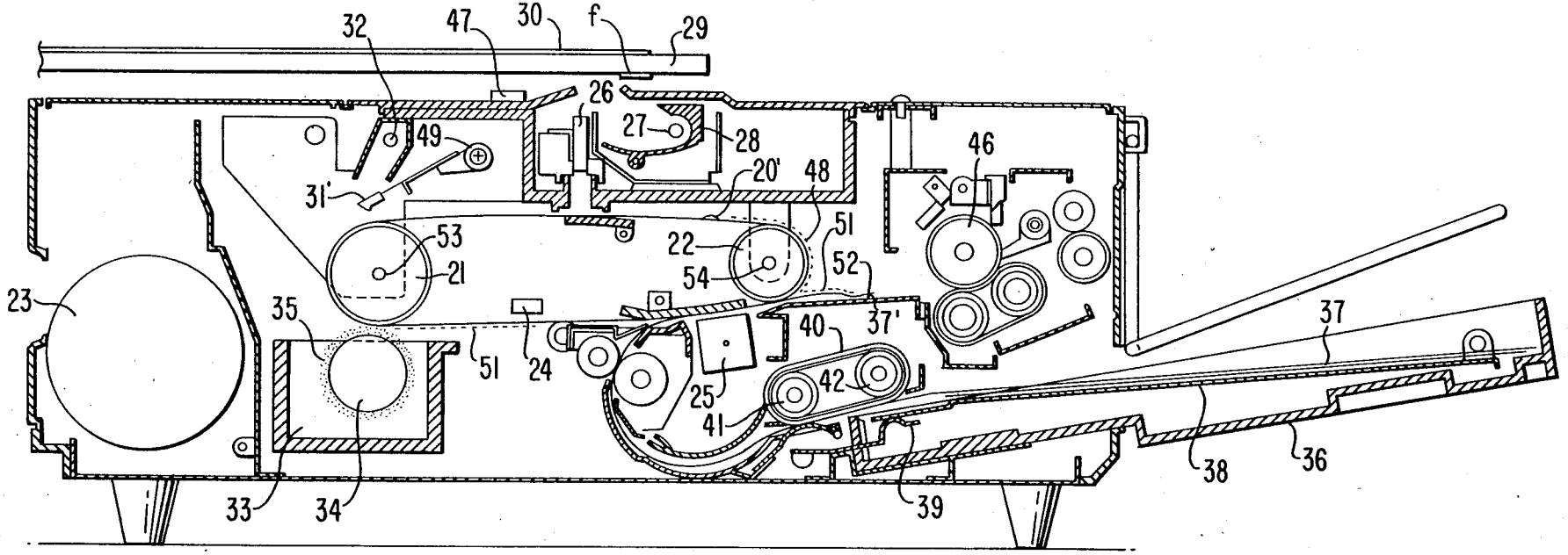
Figure 5:
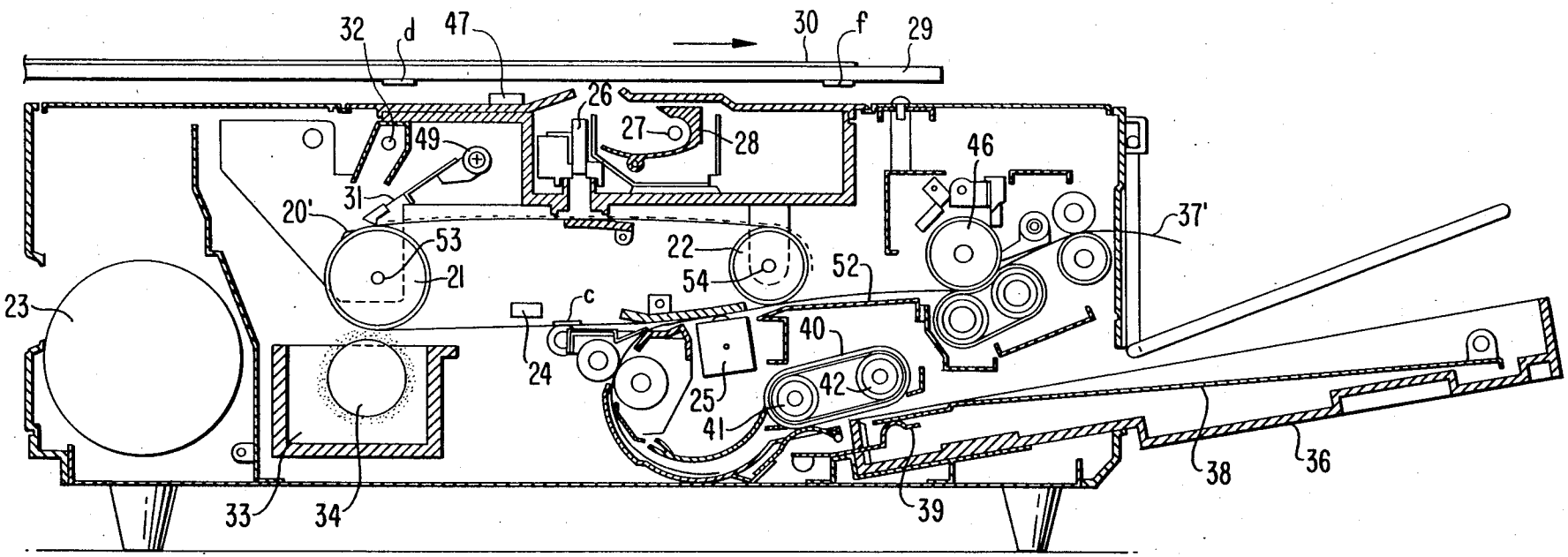

(4) Development and transfer:

As the rotation of the photosensitive belt 20 continues as shown in FIG. 4, the electrostatic latent image 50 on the photosensitive belt 20 moves past the development unit 33, and is developed by toner 35 placed on the belt by applicator 34 whereupon developed toner 51 is applied to the photosensitive belt 20. Better results in the developing process are achieved when the first roller 21 has a large diameter. In the embodiment, one first roller 21 has a diameter of 40 mm.

When the joined seam 20' of the photosensitive belt 20 moves past the corotron 25 again, that is, when the photosensitive belt position sensor 24 detects the marking a, the timing rollers 44, 45 are actuated to feed the transfer sheet 37' into a transfer passage in which the transfer sheet 37' is charged through its reverse side by the corotron 25, causing the developed toner 51 and thus the developed image to be transferred from the photosensitive belt 20 to the transfer sheet 37'. In many cases generally, the operating conditions in which the corotron 25 charges the photosensitive belt 20 are different from those in which the corotron 25 transfers the toner image to the transfer sheet 37'. Therefore, it is possible to change the corotron operating conditions from the charging mode to the transfer mode when the photosensitive belt position sensor 24 detects the marking a. The leading end of the image of the developed toner 51 and the leading end of the transfer sheet 37' can be brought into correct alignment by adjusting the position of a plate 62 on the document support 29 for positioning the leading end of the original document 30.

(5) Peeling:

Since the transfer sheet 37' is strongly charged through it reverse side by the corotron 25 for toner image transfer, the transfer sheet 37' strongly adheres to the photosensitive belt 20 due to electrostatic forces. For peeling the transfer sheet 37' from the photosensitive belt 20, it has conventionally been required to forcibly peel the transfer sheet 37' with a mechanical means such as peeling prongs, or to discharge the transfer sheet with an AC corotron. According to the present invention, as shown in FIG. 4, the photosensitive belt 20 goes around the second roller 22 immediately after it has moved past the transfer section. The second roller 22 has a diameter which is sufficiently smaller than the diameter of a conventionally photosensitive drum, the roller diameter being 20 mm or smaller. Therefore, the transfer sheet 37' is subjected to flexual rigidity and hence is peeled of its own accord from the surface of the photosensitive belt 20 against electrostatic forces acting on the belt 20. The peeled transfer sheet 37' is then delivered along a paper guide 52 toward the fixing unit 46.

When the joined seam 20' of the photosensitive belt 20 reaches the position below the fiber lens array 26 as the belt 20 rotates continuously from the position of FIG. 4, the exposure process is completed. Upon detection of the marking f by the original support position sensor 47, the document support 29 is stopped, and returns to the original position and then comes to a stop when the marking d is detected.

(6) Start of cleaning:

As illustrated in FIG. 4, non-transferred toner 48 is left on the photosensitive belt 20 from which the toner image has been transferred. As a consequence, it is necessary to clean the surface of the photosensitive belt prior to the next charging and exposure processes. When the photosensitive belt position sensor 24 detects the marking c upon continued rotation of the photosensitive belt 20 from the position of FIG. 4, the cleaning blade 31 is pressed against the photosensitive belt 20 again to start scraping the residual toner 48. Simultaneously, the discharging lamp 32 is energized to illuminate the surface of the cleaned photosensitive belt 20 to eliminate any residual potential from the photosensitive belt 20 in preparation for the next charging process.

At this time, the photosensitive belt 20 has completed two rotations from the initial position.

When the joined seam 20' passes over the corotron 25 again as the photosensitive belt 20 continuously rotates, the corotron 25 is de-energized to prevent unwanted charging of the photosensitive belt 20.

When the joined seam 20' arrives in the vicinity of the cleaning blade 31 upon continued rotation of the photosensitive belt 20, that is, when the photosensitive belt 20 makes three complete rotations, the cleaning process is finished, and the motor 23 is de-energized to complete one copying cycle. Thus, the photosensitive belt 20 has now made three full rotations.

During this time, the transfer sheet 37' with the image transferred fixed thereto has been discharged out of the copier, and the document support 29 has returned to the initial position shown in FIG. 1. The foregoing operations constitute one cycle of making one copy of the original document.

For producing a plurality of copies from one original document, the corotron 25 will be de-energized after the image has been transferred, and the next charging process is started while the document support 29 is moved to the exposure start position. This allows the original document to be successively duplicated. This mode of operation permits one copy to be produced while the photosensitive belt 20 makes two rotations, and hence has a faster copying speed than with the copying mode for making a single copy.

While in the above embodiment the discharging lamp 32 and the cleaning blade 31 are employed as the discharging means and the cleaning means, the present invention is not limited to the illustrated arrangement. The discharging means and the cleaning means may comprise any desired devices provided they have required discharging and cleaning effects. Although the present invention has been shown and described as being incorporated in the electrophotographic copier of the type in which the document support 29 is movable, the invention is also applicable to electrophotographic copiers of the type in which the original support is fixed in place and the optical system composed of a lens, a mirror, and other parts are moved for exposure.

What is claimed is:

1. An electrophotographic copier comprising:

at least first and second rollers;

a photosensitive belt having a photosensitive surface, said photosensitive belt supported by said rollers and movable in one direction;

exposure means for exposing said photosensitive surface of said photosensitive belt, said exposure means forming a latent image on said photosensitive surface when said photosensitive belt moves in a direction from said second roller towards said first roller;

development means disposed adjacent to said first roller for transferring toner onto said photosensitive surface and forming a developed image thereon;

transfer means disposed along said photosensitive surface of said photosensitive belt, said transfer means including means to feed a transfer member into contact with said photosensitive surface of said photosensitive belt at a position where said photosensitive surface has a developed image thereon, said transfer means also having means to deliver said transfer member towards said second roller;

a single corotron disposed along said photosensitive surface of said photosensitive belt between said means to feed a transfer member into contact with said photosensitive belt and said means to deliver said transfer member towards said second roller, said corotron causing charging of said photosensitive belt during a first rotation of said photosensitive belt around said rollers and said corotron causing transfer of a developed image from said photosensitive surface to a transfer member during a second rotation of said photosensitive belt around said rollers;

fixing means disposed adjacent to said second roller for fixing a transferred image on a transfer member;

guide means for guiding a transfer member from said transfer means to said fixing means; and cleaning means for removing non-transferred toner remaining on said photosensitive belt, said cleaning means disposed between said exposure means and said development means, said cleaning means causing non-transferred toner which is removed from said photosensitive belt to be returned back into said development means for reuse of said non-transferred toner.

2. The electrophotographic copier of claim 1, wherein the diameter of said second roller is sufficiently small enough to cause a transfer member to separate from said photosensitive belt when said photosensitive belt is rotated around said second roller.

3. The electrophotgraphic copier of claim 1, wherein said second roller has a diameter of 20 mm or smaller and said first roller has a diameter of 20 mm or larger.

4. The electrophotographic copier of claim 1, further comprising cleaning means and discharging means, said photosensitive belt arranged to pass in order said exposure means, said cleaning means, said discharging means, said development means and said corotron.

5. The electrophotographic copier of claim 1, wherein said cleaning means is intermittently controlled in an operative mode in which said cleaning means scrapes the toner from said photosensitive belt and an inoperative mode in which the scraped toner is carried on said photosensitive belt and delivered to said development means.

6. The electrophotographic copier of claim 5, wherein said cleaning means comprises a cleaning blade for contacting said photosensitive belt to scrape the toner, said cleaning blade being intermittently brought into and out of contact with said photosensitive belt.

7. The electrophotographic copier of claim 1, further comprising detecting means provided on an inner surface of said photosensitive belt for detecting displacement of said photosensitive belt.

8. The electrophotographic copier of claim 7, wherein said detecting means comprises markings placed on said inner surface of said photosensitive belt and a sensor disposed so as to confront said markings, said sensor composed of a light-emitting element and a photodetector which are constructed as a unit for detecting the difference between reflectivities of the photosensitive belt and said markings.

9. The electrophotographic copier of claim 8, wherein said detecting means is disposed substantially centrally of said photosensitive belt in the transverse direction thereof.

* * * * *